US007620351B2

(12) United States Patent
Onda et al.

(10) Patent No.: US 7,620,351 B2
(45) Date of Patent: Nov. 17, 2009

(54) DEVELOPING DEVICE AND IMAGE FORMING DEVICE

(75) Inventors: Hiroshi Onda, Yamatokoriyama (JP); Toshio Nishino, Yamatokoriyama (JP); Syohji Tomita, Yao (JP); Takeshi Wakabayashi, Souraku-gun (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 356 days.

(21) Appl. No.: 10/571,065

(22) PCT Filed: Sep. 7, 2004

(86) PCT No.: PCT/JP2004/012994

§ 371 (c)(1),
(2), (4) Date: Mar. 8, 2006

(87) PCT Pub. No.: WO2005/024525

PCT Pub. Date: Mar. 17, 2005

(65) Prior Publication Data

US 2007/0071507 A1 Mar. 29, 2007

(30) Foreign Application Priority Data

Sep. 9, 2003 (JP) ..... 2003-317506

(51) Int. Cl.
*G03G 15/09* (2006.01)

(52) U.S. Cl. ..... 399/274

(58) Field of Classification Search ..... 399/274
See application file for complete search history.

(56) References Cited

FOREIGN PATENT DOCUMENTS

| | | |
|---|---|---|
| JP | 58-181071 | 10/1983 |
| JP | 60-184068 U | 12/1985 |
| JP | 63-66860 U | 5/1988 |
| JP | 63-189875 A | 8/1988 |
| JP | 63-271487 | 11/1988 |
| JP | 1-85852 U | 6/1989 |
| JP | 1-237577 | 9/1989 |
| JP | 3-89273 | 4/1991 |

(Continued)

OTHER PUBLICATIONS

JPO Machine Translation of Endo et al. (JP 2002-072662 A).*

(Continued)

*Primary Examiner*—David M Gray
*Assistant Examiner*—Erika Villaluna
(74) *Attorney, Agent, or Firm*—Nixon & Vanderhye P.C.

(57) ABSTRACT

A developing device comprises a stirring roller 7 having stirring blades 7*a* for stirring a developer, a developing roller 3 for transferring the developer to an electrostatic latent image, a control member 4 for controlling the amount of developer transferred from the developing roller 3 to the electrostatic latent image, a reflux plate 6 by which the excess developer resulting from control by the control member 4 is flowed back to the stirring roller 7, one end portion of the reflux plate 6 being disposed in the vicinity of the outer periphery of the stirring roller 7, part of the developer stirred by the stirring roller 7 flying toward the reflux plate 6, wherein said one end portion of the reflux plate 6 is disposed at a position remote from the stirring roller 7 over a distance greater then the maximum fly distance of the developer provided by rotation of the stirring roller 7.

16 Claims, 10 Drawing Sheets

FOREIGN PATENT DOCUMENTS

| | | | | |
|---|---|---|---|---|
| JP | 4-330473 | A | | 11/1992 |
| JP | 5-127512 | | | 5/1993 |
| JP | 5-134540 | A | | 5/1993 |
| JP | 7-175311 | A | | 7/1995 |
| JP | 8-36294 | A | | 2/1996 |
| JP | 8-146762 | A | | 6/1996 |
| JP | 8-248763 | A | | 9/1996 |
| JP | 9-62071 | A | | 3/1997 |
| JP | 09068869 | A | * | 3/1997 |
| JP | 9-236980 | A | | 9/1997 |
| JP | 10-198172 | | | 7/1998 |
| JP | 2002-31941 | | | 1/2002 |
| JP | 2002-72662 | A | | 3/2002 |

OTHER PUBLICATIONS

International Search Report of PCT/JP2004/012994, mailed Dec. 7, 2004.

* cited by examiner

DEVELOPING DEVICE AND IMAGE FORMING DEVICE

CROSS-REFERENCE TO RELATED APPLICATIONS

This application is the national phase under 35 U.S.C. §371 of PCT International Application No. PCT/JP04/12994 which has an International filing date of Sep. 7, 2004 and designated the United States of America.

BACKGROUND OF THE INVENTION

1. Field of the Invention

The described technology relates to a developing device used in an image forming device such as a copying machine, a printer, and a facsimile machine employing an electro-photographic system, and relates to an image forming device.

2. Description of Related Art

FIG. 1 is a sectional view showing the configuration of a conventional developing device. The developing device used in an image forming device such as a copying machine employing an electro-photographic system comprises: a case 104 for storing binary developer; a stirring roller 105 for stirring the developer inside the case 104; a developing roller 101 for transferring the developer to an electrostatic latent image; a control member 102 for controlling the amount of developer transferred to the electrostatic latent image; and a reflux plate 103 for flowing back excess developer controlled by the control member 102 to the stirring roller 105 (see, for example, Japanese Patent Application Laid-Open No. 1-237577 (1989)). Another developing device using binary developer is also known in which a folded piece is provided at an end portion on a control member side of a reflux plate for flowing back excess developer controlled by the control member to a stirring roller (see, for example, Japanese Patent Application Laid-Open No. 3-89273 (1991)).

The developing roller 101 comprises: a non-rotary magnet roller 100 provided with magnetic N-poles and magnetic S-poles disposed alternately at a plurality of positions in the circumferential direction; and a nonmagnetic sleeve 106 fitted to the outside of the magnet roller 100 in a freely rotatable manner. One end portion of the reflux plate 103 is disposed in the vicinity of the outer periphery of the stirring roller 105, while the opposite side of said one end portion is disposed in the vicinity of the outer periphery of the developing roller 101. The control member 102 is disposed in the vicinity of the outer periphery of the developing roller 101 in the downstream side (left-hand side in the figure) of the transfer direction relative to the opposite side of said one end portion of the reflux plate 103.

In the developing device constructed as described above, carrier (magnetic powder) and toner of the binary developer stored in the case 104 are stirred by rotation (in the counterclockwise direction in the figure) of the stirring roller 105, and the toner adheres to the periphery surface of the carrier. Further, when the sleeve 106 of the developing roller 101 rotates (counterclockwise in the figure), the developer is transferred toward a gap between the developing roller 101 and the control member 102, so that the transferring amount to the electrostatic latent image is controlled by the control member 102. The developer having passed through the gap is transferred to the electrostatic latent image, while excess developer resulting from control by the control member 102 stagnates in the space between the control member 102 and the reflux plate 103. When the stagnated amount increases, the developer is flowed toward the reflux plate 103, then guided by the reflux plate 103, and thereby flowed back to the stirring roller 105.

As described above, the developer circulates inside the case 104 via the control member 102, the reflux plate 103, and the like. Nevertheless, for example, when the developer deposits on the reflux plate 103 so that the reflux of the developer is blocked, a problem arises that smooth circulation of the developer is prevented. When smooth circulation of the developer is prevented, adverse influences are caused such as unstable image quality.

BRIEF SUMMARY OF THE INVENTION

One or more aspects of the present invention address this situation. An object is to provide a developing device in which arrangement of one end portion of a reflux plate is optimized in the vicinity of the outer periphery of a stirring roller so that reflux of developer is stabilized.

Another object is to provide a developing device in which arrangement of one end portion of a reflux plate is optimized in the vicinity of the outer periphery of a stirring roller so that the rate of circulation of developer is enhanced.

Yet another object is to provide a developing device in which the inclination angle of a reflux plate is optimized so that reflux of developer is stabilized.

Further, another object is to provide a developing device in which arrangement of one end portion of a reflux plate is optimized in the vicinity of the outer periphery of a stirring roller so that mixing of flowed-back developer and supplied developer is improved.

Further, another object is to provide a developing device in which small-grain diameter developer is used so that image quality is improved.

Further, another object is to provide an image forming device in which image quality of an image formed on a sheet is stabilized.

A developing device according to a non-limiting embodiment is a developing device comprising: a stirring roller having stirring blades for stirring a developer; a developing roller for transferring the developer to a electrostatic latent image; a control member for controlling the amount of developer transferred to the electrostatic latent image by said developing roller; and a reflux plate for flowing back excess developer by controlling of said control member to said stirring roller; wherein one end portion of said reflux plate is disposed in the vicinity of the outer periphery of said stirring roller, and part of the developer stirred by said stirring roller flies toward said reflux plate, and is characterized in that said one end portion of said reflux plate is disposed at a position remote from said stirring roller over a distance greater than the maximum fly distance of the developer provided by rotation of said stirring roller.

A developing device according to the embodiment characterized in that said one end portion of said reflux plate is disposed above in the vertical direction of said stirring roller, and said maximum fly distance is the maximum fly distance in the vertical direction.

A developing device according to the embodiment is a developing device comprising: a stirring roller having stirring blades for stirring a developer; a developing roller for transferring the developer to an electrostatic latent image; a control member for controlling the mount of developer transferred to the electrostatic latent image by said developing roller; and a reflux plate for flowing back excess developer by controlling of said control member to said stirring roller; wherein one end portion of said reflux plate is disposed in the vicinity of the outer periphery of said stirring roller, and is characterized in that said one end portion of said reflux plate is disposed within a predetermined range from a position where a plane passing through the rotation center axis of said stirring roller and crossing said reflux plate at right angles intersects said reflux plate.

A developing device according to the embodiment is characterized in that said one end portion of said reflux plate is disposed at a position where a plane passing through the rotation center axis of said stirring roller and crossing said reflux plate at right angles intersects said reflux plate.

A developing device according to the embodiment is characterized in that an inclination angle of said reflux plate is larger than an angle of repose.

A developing device according to the embodiment is characterized by further comprising a developer supplying portion from which the developer is supplied, wherein said stirring roller is disposed between said developer supplying portion and said developing roller, and said one end portion of said reflux plate is disposed in the vicinity of the outer periphery on said developer supplying portion side of said stirring roller.

A developing device according to the embodiment is characterized in that said stirring roller stirs the developer containing magnetic powder having an average grain diameter of 65 μm or smaller and toner having an average grain diameter of 7.5 μm or smaller.

An image forming device according to a non-limiting embodiment is characterized by comprising a developing device according to above mentioned embodiment for developing an electrostatic latent, and an image forming unit for forming on a sheet an image developed by said developing device.

In a developing device in which one end portion of a reflux plate is disposed in the vicinity of the outer periphery of a stirring roller having stirring blades and in which part of the developer stirred by the stirring roller flies toward the reflux plate, said one end portion of the reflux plate is disposed at a position remote from the stirring roller over a distance greater than the maximum fly distance of the developer provided by rotation of the stirring roller. Thus, even when the developer stirred by the stirring roller flies toward the reflux plate, since said one end portion of the reflux plate is remote from the stirring roller over a distance greater than the maximum fly distance of the developer, the developer does not reach said one end portion, and hence deposition of the developer is prevented.

In a non-limiting embodiment, one end portion of the reflux plate is disposed above in the vertical direction of the stirring roller having stirring blades, while said one end portion of the reflux plate is disposed at a position remote from the stirring roller over a distance greater than the maximum fly distance of the developer in the vertical direction. Thus, even when the developer stirred by the stirring roller flies toward the reflux plate, since said one end portion of the reflux plate is remote from the stirring roller over a distance greater than the maximum fly distance of the developer in the vertical direction, the developer does not reach said one end portion, and hence deposition of the developer is prevented.

In a developing device in which one end portion of a reflux plate is disposed in the vicinity of the outer periphery of a stirring roller, said one end portion of the reflux plate is disposed within a predetermined range from a position where a plane passing through the rotation center axis of the stirring roller and crossing the reflux plate at right angles intersects the reflux plate. Thus, since the amount of developer transferred to a control member for controlling the transferring amount to an electrostatic latent image increases when said one end portion of the reflux plate approaches the position where the plane passing through the rotation center axis of the stirring roller crosses the reflux plate at right angles, the rate of circulation of the developer can be made to be larger.

In an aspect, one end portion of the reflux plate is disposed at a position where a plane passing through the rotation center axis of the stirring roller and crossing the reflux plate at right angles intersects the reflux plate. Thus, since the amount of developer transferred to a control member for controlling the transferring amount to an electrostatic latent image increases when said one end portion of the reflux plate approaches the position where the plane passing through the rotation center axis of the stirring roller crosses the reflux plate at right angles, the rate of circulation of the developer can approach the maximum.

In an aspect, an inclination angle of the reflux plate is set larger than an angle of repose at which accumulated developer remains stable without collapsing. Then, since the inclination angle is larger than the angle of repose, the developer is prevented from stably depositing on the reflux plate, and hence reflux of the developer is stabilized.

In an aspect, the stirring roller is disposed between the developer supplying portion and the developing roller, while one end portion of the reflux plate is disposed in the vicinity of the outer periphery on the developer supplying portion side of the stirring roller. Thus, since excess developer is flowed back from the reflux plate to the developer supplying portion side of the stirring roller, and mixing of the developer having been flowed back and the developer supplied from the developer supplying portion can be improved.

In an aspect, a small-grain diameter developer containing magnetic powder having an average grain diameter of 65 μm or smaller and toner having an average grain diameter of 7.5 μm or smaller is stirred by the stirring roller. When the small-grain diameter developer is used, image quality is improved. Nevertheless, developer of small grain diameter aggregates easily and has a tendency that its fluidity becomes poor and hence causes instability in the circulation. However, as described above, the developer is prevented from depositing on the reflux plate, or alternatively the rate of circulation of the developer is improved, yet alternatively, mixing of the developer is improved. Thus, even when such small-grain diameter developer is used, circulation of the developer is stabilized.

In an aspect, the developing device described above develops an electrostatic latent image. Then, an image forming unit forms the developed image onto a sheet. The circulation of the developer is stabilized as described above, so that image quality formed on the sheet can be stabilized.

In an aspect, one end portion of the reflux plate is disposed at a position remote from the stirring roller over a distance greater than the maximum fly distance of the developer provided by rotation of the stirring roller, so that the developer does not reach said one end portion, and hence deposition of the developer is prevented. This prevention of deposition of the developer stabilizes the reflux of the developer.

In an aspect, one end portion of the reflux plate is disposed at a position which is located above in the vertical direction and which is remote from the stirring roller over a distance greater than the maximum fly distance of the developer in the vertical direction, so that the developer does not reach said one end portion, and hence deposition of the developer is prevented. This prevention of deposition of the developer stabilizes the reflux of the developer.

In an aspect, one end portion of the reflux plate is disposed within a predetermined range from a position where a plane passing through the rotation center axis of the stirring roller and crossing the reflux plate at right angles intersects the reflux plate, so that the amount of developer transferred to the control member increases, and hence the rate of circulation of the developer can be made to be larger.

In an aspect, one end portion of the reflux plate is disposed at a position where a plane passing through the rotation center axis of the stirring roller and crossing the reflux plate at right angles intersects the reflux plate, so that the amount of developer transferred to the control member reaches the maximum, and the rate of circulation of the developer reaches the maximum.

In an aspect, the inclination angle of the reflux plate is made to be larger than the angle of repose, so that the developer can not deposit stably on the reflux plate, and hence the circulation of the developer is stabilized.

In an aspect, one end portion of the reflux plate is disposed on the developer supplying portion side of the stirring roller, so that excess developer is flowed back to the developer supplying portion side of the stirring roller. Thus, the mixing of the developer having been flowed back and the developer supplied from the developer supplying portion can be improved. This improvement in the mixing of the developer stabilizes image quality.

In an aspect, by using small-grain diameter developer, image quality is improved. Further, even when such small-grain diameter developer is used, circulation of the developer can be stabilized as described above.

In an aspect, a developing device in which circulation of the developer can be stabilized as described above is used, so that image quality of an image formed on a sheet can be stabilized.

The above and further objects and features will more fully be apparent from the following detailed description with accompanying drawings.

BRIEF DESCRIPTION OF THE SEVERAL VIEWS OF THE DRAWINGS

FIG. 9 is an exploded perspective view showing a supporting structure for a developing roller, a reflux plate, and the like.

DETAILED DESCRIPTION OF THE PRESENT INVENTION

Figure 1:
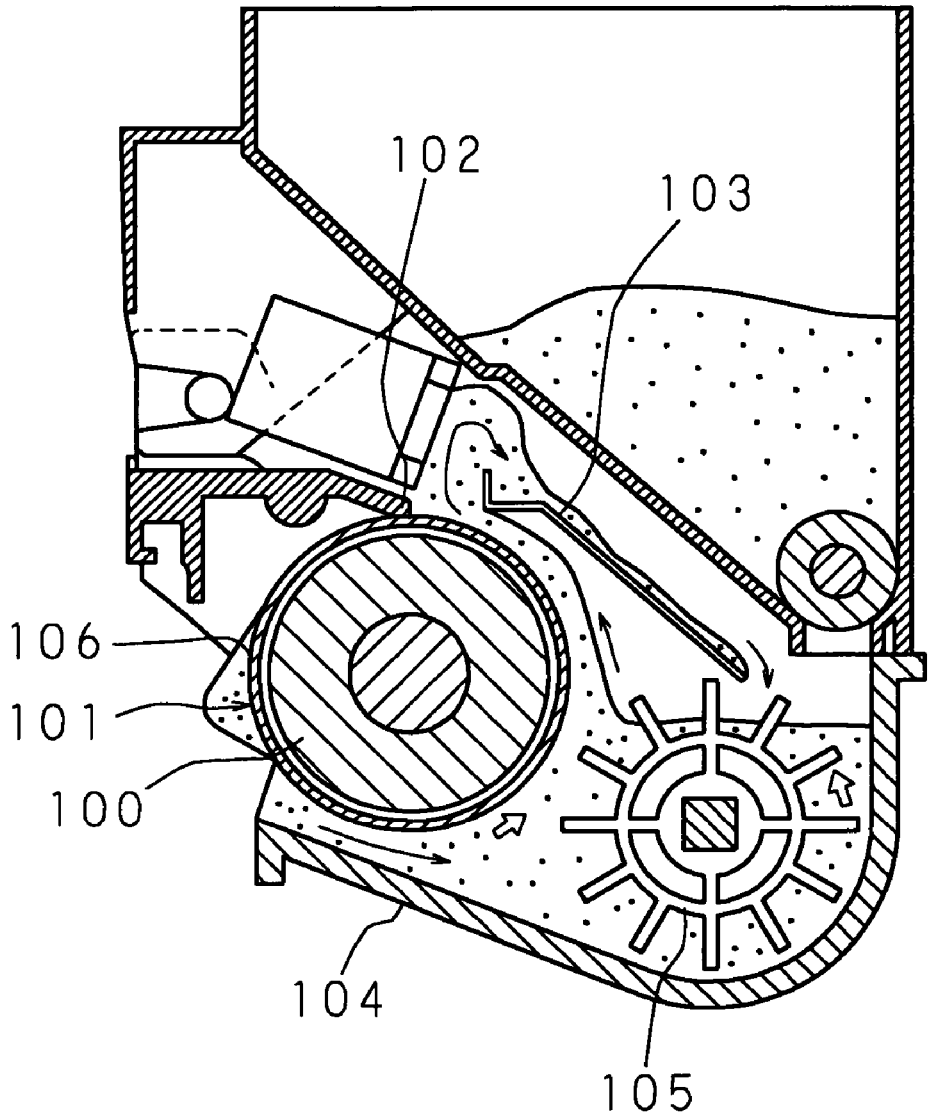
FIG. 1 PRIOR ART
FIG. 1 is a sectional view showing the configuration of a conventional developing device.
Figure 2:
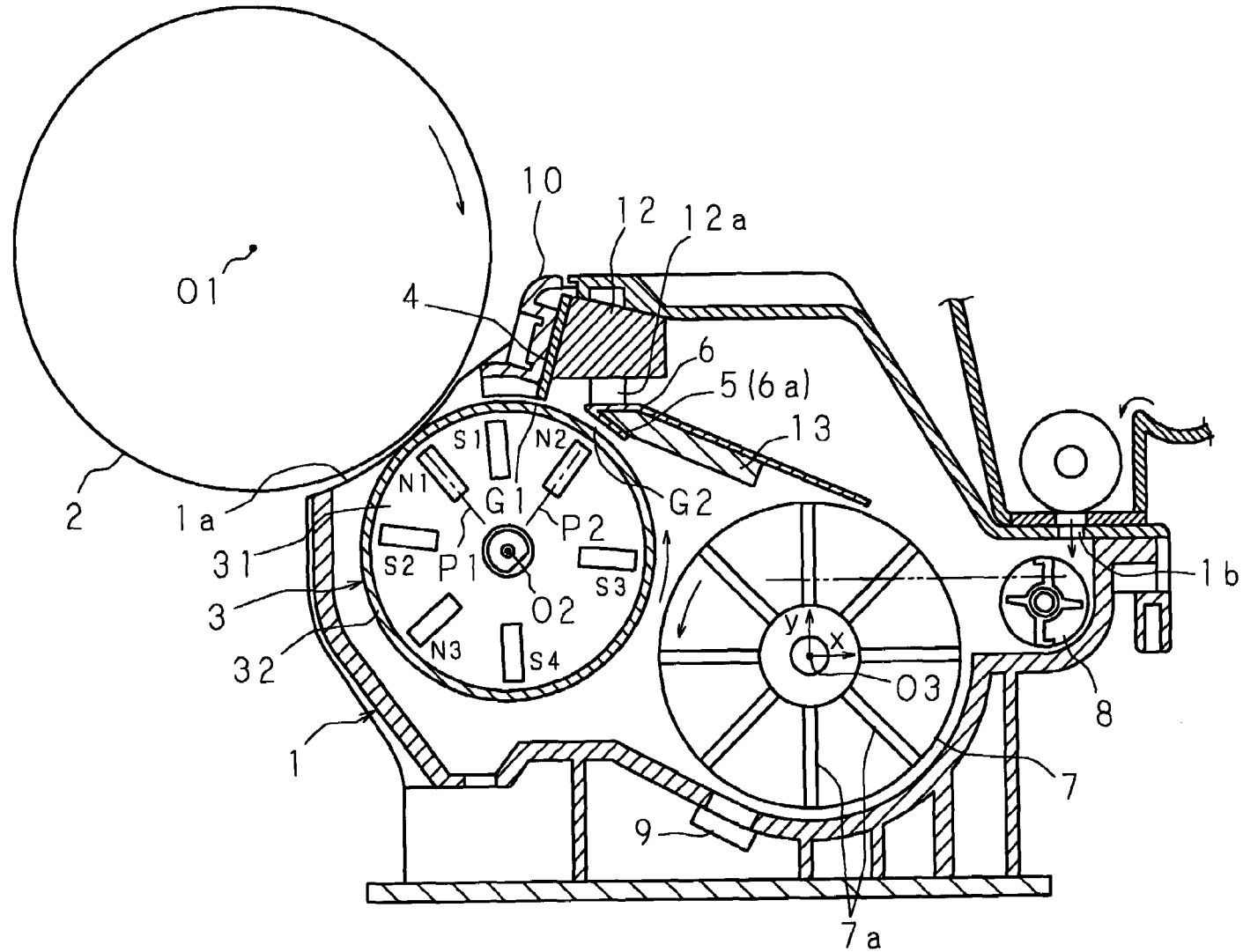
FIG. 2 is a sectional view showing the configuration of a developing device according to a non-limiting embodiment.

One or more aspects are described below in detail with reference to the drawings showing embodiments. FIG. 2 is a sectional view showing the configuration of a developing device according to a non-limiting embodiment. The developing device comprises: a case 1 for storing binary developer; a stirring roller 7 having stirring blades 7*a* and stirring the developer inside the case 1; a developing roller 3 for transferring the developer to an electrostatic latent image carried on a photosensitive drum 2 and for developing the electrostatic latent image; a control member 4 controlling the transferring amount of the developer to the electrostatic latent image at midway to the developing roller 3; a scraping member 5 facing the developing roller 3 with spacing of a second gap G2 larger than a first gap G1 formed between the developing roller 3 and the control member 4, controlling the layer thickness of the developer transferred to the first gap G1, and then scraping the developer; and a reflux plate 6 by which excess developer resulting from control by the control member 4 is flowed back to the stirring roller 7. In addition, the control member 4 and the scraping member 5 are formed in a length corresponding to that of the developing roller 3.

The case 1 has an approximate prism shape provided with an opening portion 1*a* located at a position facing the periphery surface of the photosensitive drum 2. A developer supplying portion 1*b* is opened on the opposite side to the opening portion 1*a*. The developing roller 3 and the control member 4 are disposed at positions facing the opening portion 1*a* inside the case 1. The stirring roller 7 is disposed at a position facing the developer supplying portion 1*b*. Further, a transfer roller 8 for transferring to the stirring roller 7 the developer (toner) supplied from the developer supplying portion 1*b* into the case 1 is disposed between the developer supplying portion 1*b* and the stirring roller 7. The stirring roller 7 and the transfer roller 8 rotate counterclockwise.

Further, a magnetic permeability sensor 9 for detecting the concentration of the toner inside the case 1 is provided under the stirring roller 7. When the toner amount stirred by the stirring roller 7 goes below an appropriate value, the toner is supplied from the developer supplying portion 1*b* on the basis of the detected value of the magnetic permeability sensor 9.

The developing roller 3 comprises: a magnet roller 31 of multi-electrode magnetization in which magnetic poles N1, N2, N3 and magnetic poles S1, S2, S3, S4 each composed of a bar magnet having a rectangular cross section are disposed in a radial manner at a plurality of positions in the circumferential direction; and a nonmagnetic sleeve 32 fitted to the outside of the magnet roller 31. The magnet roller 31 does not rotate, whereas the sleeve 32 is configured so at to rotate counterclockwise. Both ends of the magnet roller 31 are supported by both side walls of the case 1 in a non-rotary manner, and the magnetic pole N1 is disposed at a position facing the periphery surface of the photosensitive drum 2, while the magnetic pole N2 is disposed at a position facing the second gap G2. Each of the magnetic poles N1 and N2 has the center of magnetic pole (pole center axis P1 or P2) at the center of the width dimension in the circumferential direction of the developing roller 3.

The magnetic pole N1 facing the periphery surface of the photosensitive drum 2 is disposed in such a manner that the pole center axis P1 is displaced by 3° toward the upstream side (the magnetic pole S1 side) of the developer transferring direction relative to a straight line passing through the center axis O1 of the photosensitive drum 2 and the center axis O2 of the developing roller 3. The displacement amount of the pole center axis P1 is measured with a measuring instrument. This measuring instrument has, for example, a magnetic needle that rotates about the center axis O1 of the photosensitive drum 2, so that the displacement amount is detected on the basis of the rotation angle of the magnetic needle. Further, the control member 4, on which a cover body 10 is mounted, is disposed between the magnetic poles S1 and N2 in the inner side of the opening portion 1*a* of the case 1. Here, the control member 4 and the scraping member 5 are formed by metal plates such as aluminum or stainless steel.

Figure 3:
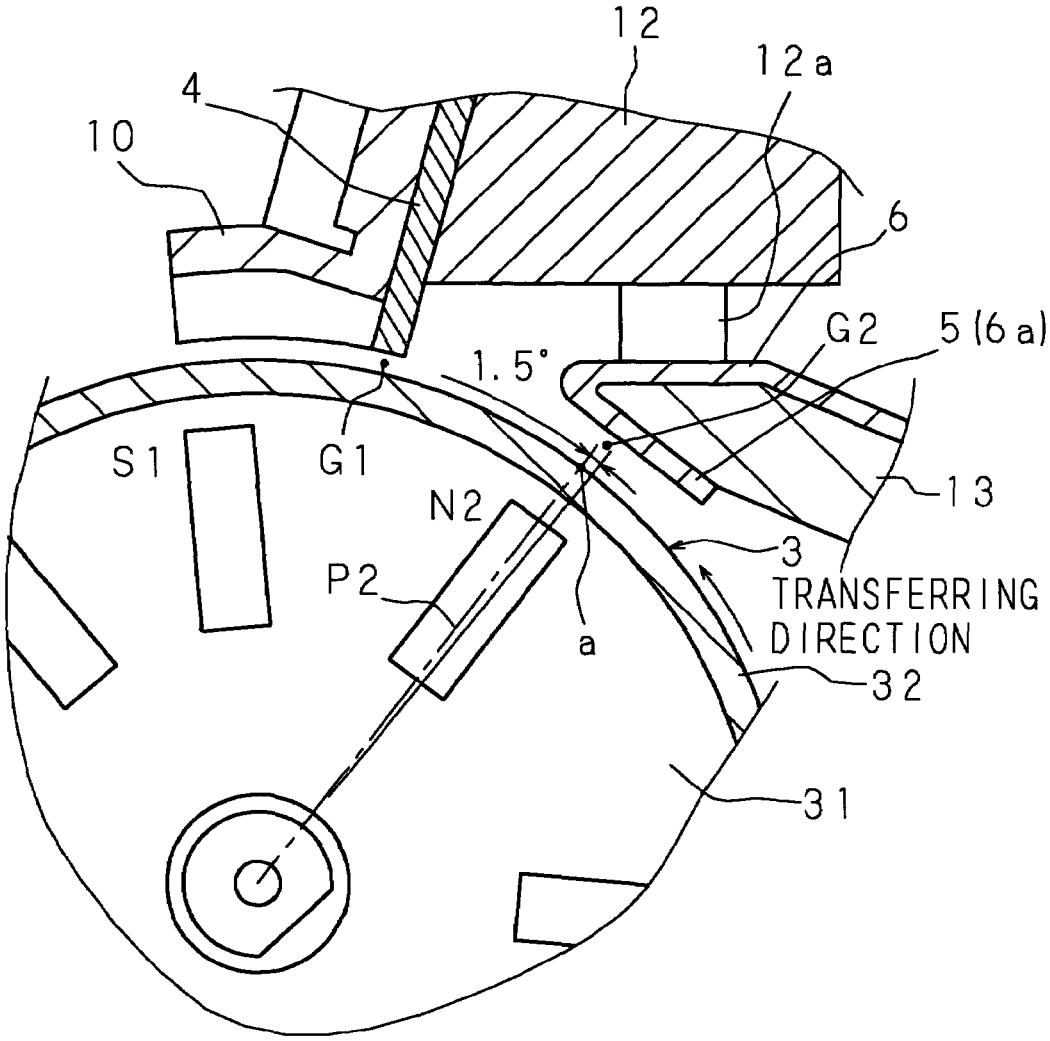
FIG. 3 is an enlarged view of the essential portion of a developing device according to a non-limiting embodiment.

FIG. 3 is an enlarged view of the essential portion of the developing device shown in FIG. 2. Since the scraping member 5 is flat, whereas the developing roller 3 is circular, a minimum position "a" exists in the second gap G2. The magnetic pole N2 facing the second gap G2 is disposed on the control member 4 side (in the downstream side of the developer transferring direction) of a position where the pole center axis P2 is displaced by 1.5° from the minimum position "a" of the second gap G2 to the opposite side to the control member 4 (in the upstream side of the developer transferring direction). Further, the width dimension Dm of the magnetic pole N2 along the circumferential direction of the developing roller 3 is made to be 4 mm.

The control member 4 performs main electrostatic charging of the developer for controlling the transferring amount of the developer at midway to the developing roller 3. The control member 4 can be formed of a nonmagnetic metal plate having a rectangular cross section, and periphery surface thereof faces the periphery surface of the developing roller 3 with spacing of the first gap G1. The control member 4 and the scraping member 5 can be formed, for example, of similar materials such as to have approximately the same coefficient of linear expansion. Thus, even when curvature displacement occurs in the control member 4 and the scraping member 5 owing to a temperature change, variation of the first and the second gaps G1 and G2 can be limited at minimum.

The scraping member 5 scrapes the developer so as to perform preliminary electrostatic charging of the developer for controlling the transferring amount (the layer thickness) of the developer transferred to the first gap G1 at midway to the developing roller 3. The scraping member 5 is formed integrally with the nonmagnetic reflux plate 6. The reflux plate 6 is located from the above portion of the developing roller 3 (the upper end portion, hereafter) to the above portion of the stirring roller 7 (the lower end portion, hereafter) in an inclined manner such that the developing roller 3 side (the upper end portion) becomes high. An end portion on the developing roller 3 side of the reflux plate 6 is folded back toward the developing roller 3 side, so that a folded piece 6*a* is formed, and the folded piece 6*a* is made to be the scraping member 5.

Prior to a transfer of the developer to the first gap G1, the scraping member 5 scrapes the developer and thereby performs preliminary electrostatic charging of the developer. Thus, when the developer is a binary developer, a repulsive face acts between respective parts of excess developer generated by the control member 4, and thereby prevents the excessive developer parts from combining with each other. This achieves smooth circulation of the developer. Further, since the scraping member 5 and the reflux plate 6 are integrated with each other, they reinforce each other so that displacement of the scraping member 5 in the expanding direction of the gap caused by a drag generating when the developer is scraped can be reduced. In the example of FIG. 2, the scraping member 5 is formed integrally with the reflux plate 6. However, the scraping member may be formed separately from the reflux plate.

The second gap G2, the first gap G1 (mm), and the width dimension Dm (mm) of the magnetic pole N2 are set up such that the following relation should hold substantially.

$$G1<G2\leqq 0.8\times Dm$$

For example, preferably, the first gap G1 is made to substantially be 0.5 mm, while the second gap G2 is substantially made to be between 2.3 mm and 3.2 mm. Since the magnetic pole N2 is disposed in the vicinity of the scraping member 5 while the width dimension Dm of the magnetic pole N2 substantially satisfies $G1<G2\leqq 0.8\times Dm$, the magnetic flux density can be enhanced in the vicinity of the scraping member 5. Accordingly, preliminary charging can be efficiently performed. Further, the width dimension Dm of the magnetic pole N2 is substantially made to be 4 mm as described above. However, this width dimension may be an appropriate dimension.

Further, the first gap G1, the second gap G2, the amount of the developer M1 (g/s/cm) transferred from the first gap G1, and the amount of developer M2 (g/s/cm) to be transferred to the second gap G2 are set up such that the following relation should substantially hold.

$$M2>(M1/G1)G2$$

Here, M1 and M2 are based on the passing amount for substantially 10 seconds in a portion where a length dimension of substantially 5 cm in the longitudinal direction (center axis direction of the developing roller 3) of the control member 4 and the scraping member 5. (M1/G1) is the passing amount (g) per unit length of the gap G1. By establishing (M2/G2)>(M1/G1), the control member 4 stably scrapes and contacts with the developer, so that the circulation amount by the preliminary electrostatic charging can be increased.

In the vicinity of the control member 4 disposed inside the case 1, a first developer stagnation suppressing member 12 is provided for suppressing the stagnation of excess developer whose transferring is controlled by the control member 4. Further, in the vicinity of the scraping member 5, a second developer stagnation suppressing member 13 is attached for suppressing the stagnation of the developer to be transferred to the second gap G2.

The first developer stagnation suppressing member 12, and the second developer stagnation suppressing member 13 can be formed of nonmagnetic materials such as metal or synthetic resin having a length corresponding to that of the developing roller 3. The first developer stagnation suppressing member 12 is disposed between the upper end portion of the reflux plate 6 and the upper wall of the case 1 remote from the reflux plate 6, and flows back excess developer smoothly to the reflux plate 6. Further, under surface of the first developer stagnation suppressing member 12, a plurality of protruding portions 12*a* that contact with the upper surface of the reflux plate 6 protrude with spacing in the longitudinal direction. Upward bending of the reflux plate 6 is regulated by the protruding portions 12*a*. As such, since the protruding portions 12*a* contact with the reflux plate 6 and thereby suppress the displacement of the scraping member 5, displacement of the scraping member 5 in the expanding direction of the gap caused by a drag generating when the developer is scraped can be reduced. Here, the first developer stagnation suppressing member 12 shown in FIG. 2 is provided from the control member 4 to the upper end portion of the reflux plate 6.

However, the length of the first developer stagnation suppressing member 12 from the control member 4 is not limited to a specific value. Further, the first developer stagnation suppressing member 12 may be integrated with the control member 4.

The second developer stagnation suppressing member 13 extends from the upper end portion of the reflux plate 6 along the under surface of the reflux plate 6, and thereby transfers the developer smoothly to the second gap G2. Here, the second developer stagnation suppressing member 13 may be integrated with the reflux plate 6.

Figure 4A:
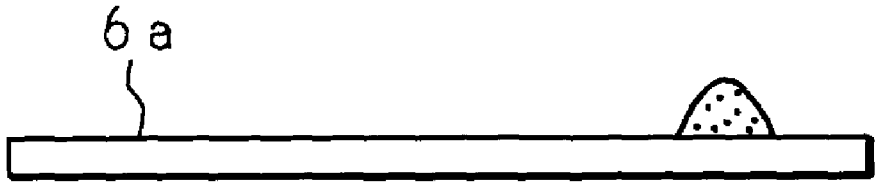
FIG. 4A, FIG. 4B and FIG. 4C are diagrams showing an angle of repose.
Figure 4B:
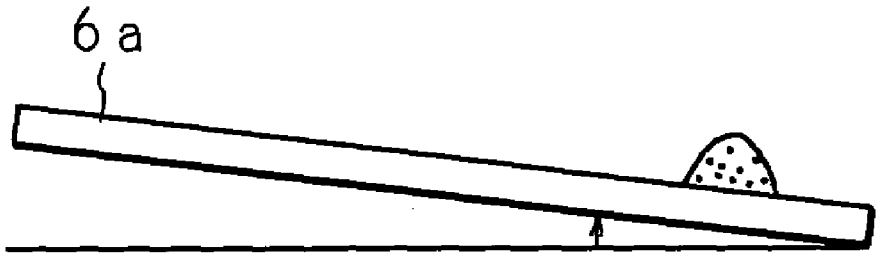
Figure 4C:
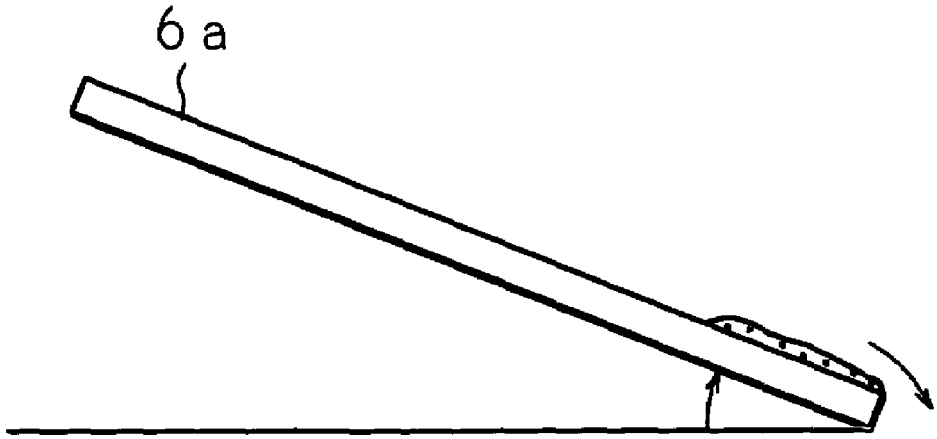

The inclination angle of the reflux plate 6 is larger than a angle of repose at which accumulated developer remains stable without collapsing. FIG. 2 shows the state where the developing device is installed horizontally. Then, the center of rotation of the stirring roller 7 is made to be the origin, and the horizontal rightward direction is made to be the X-direction, while the vertical upward direction is made to be the Y-direction. The inclination angle and the angle of repose are defined with reference to the X-direction. FIG. 4A through FIG. 4C are exemplary diagrams for the angle of repose. FIG. 4A is a diagram showing a state where the developer is accumulated in the vicinity of one end portion of the reflux plate 6*a* in the horizontal state. FIG. 4B is a diagram showing a state where the other end portion is raised so that the reflux plate 6*a* is inclined. However, the developer accumulated in the vicinity of the one end portion remains stable without collapsing. FIG. 4C is a diagram showing a state where the reflux plate 6*a* is inclined further, and the developer accumulated in the vicinity of the one end portion collapses. The angle of repose of the developer is the maximum angle of inclination at which accumulated developer remains stable without collapsing, as defined in JIS R9301-2-2. By making the inclination angle of the reflux plate 6 become larger than the angle of repose, the developer is prevented from depositing on the reflux plate 6, so that reflux can be stably performed.

Figure 5:
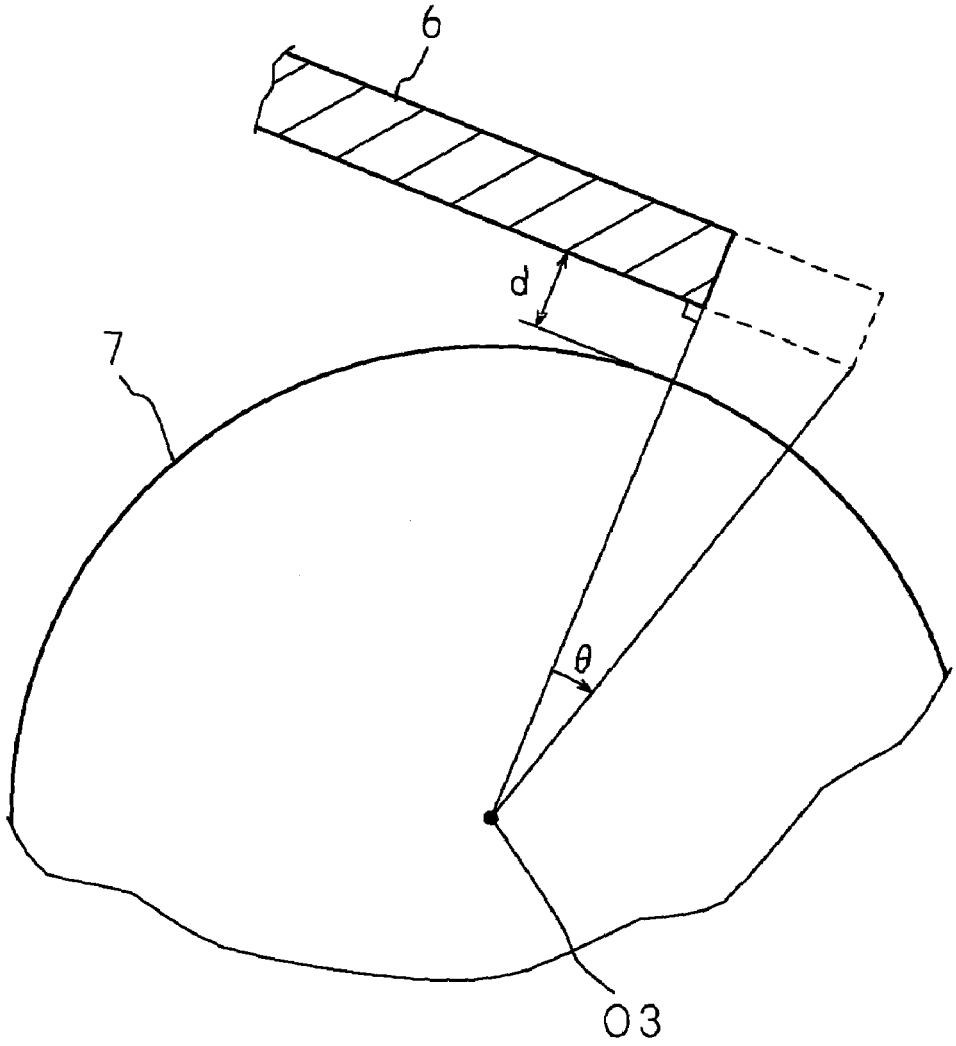
FIG. 5 is a diagram showing an example of an arrangement of a lower end portion of a reflux plate.

Further, an end portion (the lower end portion) on the stirring roller 7 side of the reflux plate 6 is disposed within a predetermined range from a position where a plane passing through the rotation center axis O3 of the stirring roller 7 and crossing the reflux plate 6 at right angles intersects the reflux plate 6. FIG. 5 is a diagram showing an example of an arrangement of the lower end portion of the reflux plate 6. In the example of FIG. 5, the lower end portion of the reflux plate 6 is disposed at a position where the above mentioned plane passing through the rotation center axis O3 of the stirring roller 7 crosses the reflux plate 6 at right angles.

Figure 6:
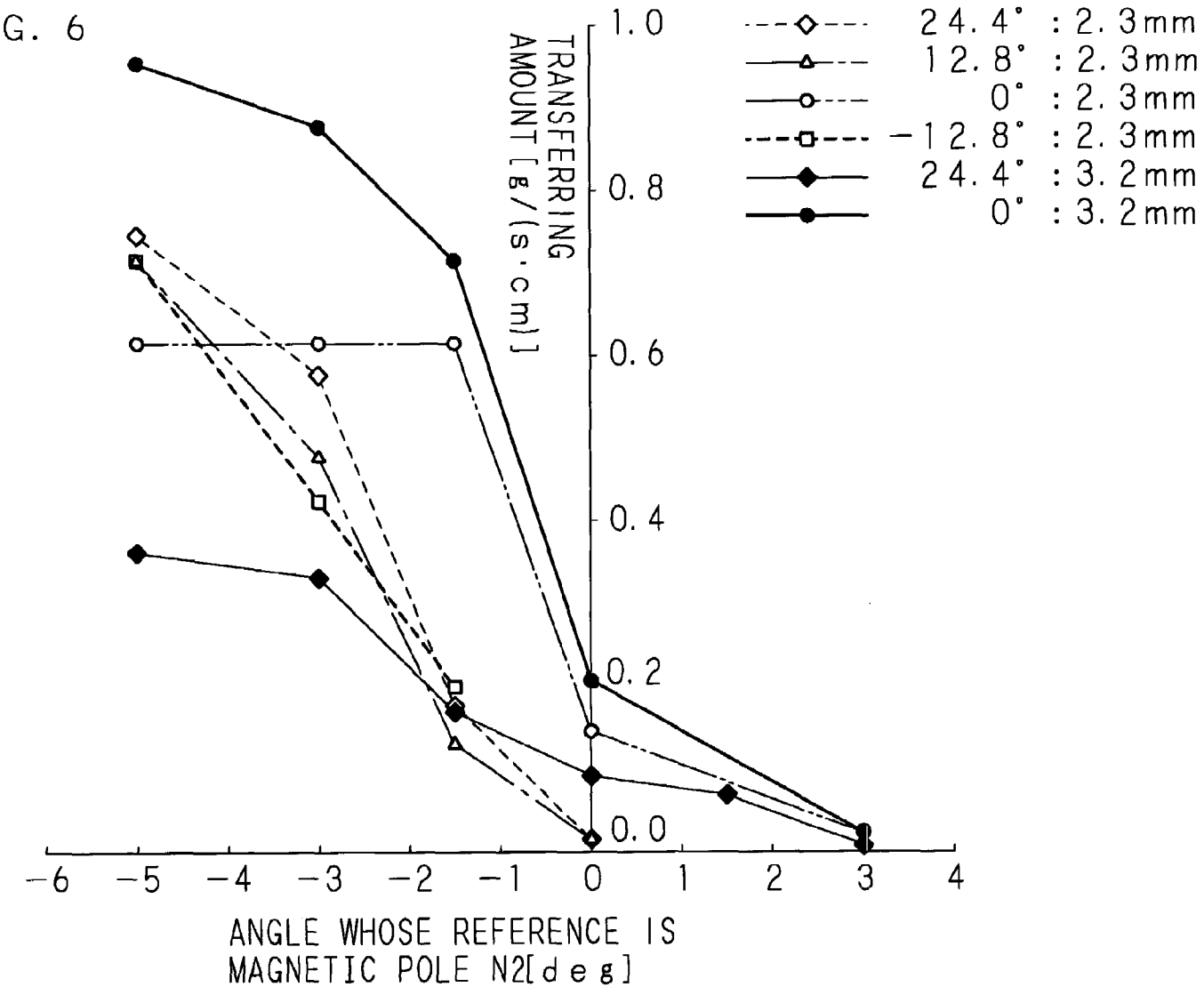
FIG. 6 is a diagram showing the transferring amount of developer in a second gap part, in which the position of a lower end portion of a reflux plate is adopted as a parameter.

FIG. 6 is a diagram showing the transferring amount of the developer in a portion of the second gap G2, in which the position of the lower end portion of the reflux plate 6 is made to be a parameter. Here, the outer periphery position (the horizontal axis in FIG. 6) of the developing roller 3 in the portion of the gap G2 is expressed by an angle whose reference is the pole center axis P2 of the magnetic pole N2. The upstream side of transferring direction is positive, while the downstream side of transferring direction is negative. Further, as shown in FIG. 5, the position of the lower end portion of the reflux plate 6 is expressed by an angle θ (the clockwise direction is positive) formed by the plane passing through the rotation center axis O3 and the lower end portion with reference to the plane passing through the rotation center axis O3 of the stirring roller 7 crosses the reflux plate 6 at right angles. When the angle θ is larger, a length from the upper end portion to the lower end portion of the reflux plate 6 becomes longer.

In the examples of FIG. 6, the transferring amount is illustrated for the cases of θ=24.4° (G2=2.3 mm), θ=12.8° (G2=2.3 mm), θ=0° (G2=2.3 mm), θ=−12.8° (G2=2.3 mm), θ=24.4° (G2=3.2 mm), and θ=0° (G2=3.2 mm). Here, the minimum length d between the reflux plate 6 and the outer periphery of the stirring roller 7 is made to be 1.5 mm. The transferring amount of the developer in the portion of the gap G2 varies depending on the position (angle θ) of the lower end portion of the reflux plate 6. Although, the transferring amount reaches the maximum when θ=0° (in the state shown in FIG. 5).

In the example of FIG. 5, the lower end portion of the reflux plate 6 is located at the position (θ=0°) where the plane passing through the rotation center axis O3 of the stirring roller 7 crosses the reflux plate 6 at right angles. However, the lower end portion of the reflux plate 6 is not limited to θ=0°, and may be within a predetermined range, for example, of θ=−6°s through +6°.

Further, the lower end portion of the reflux plate 6 is disposed in the vicinity of the outer periphery of the stirring roller 7. Thus, part of the developer stirred by the stirring roller 7 flies toward the reflux plate 6. Here, in FIG. 2, the amount of the developer in the vicinity of the stirring roller 7 is indicated by an alternate long and two short dashes line. The lower end portion of the reflux plate 6 is disposed at a position remote from the stirring roller 7 over a distance greater than the maximum fly distance of the developer provided by rotation of the stirring roller 7. More specifically, the lower end portion of the reflux plate 6 is disposed above in the vertical direction of the stirring roller 7, while the maximum fly distance described above is the maximum fly distance in the vertical direction.

Figure 7:
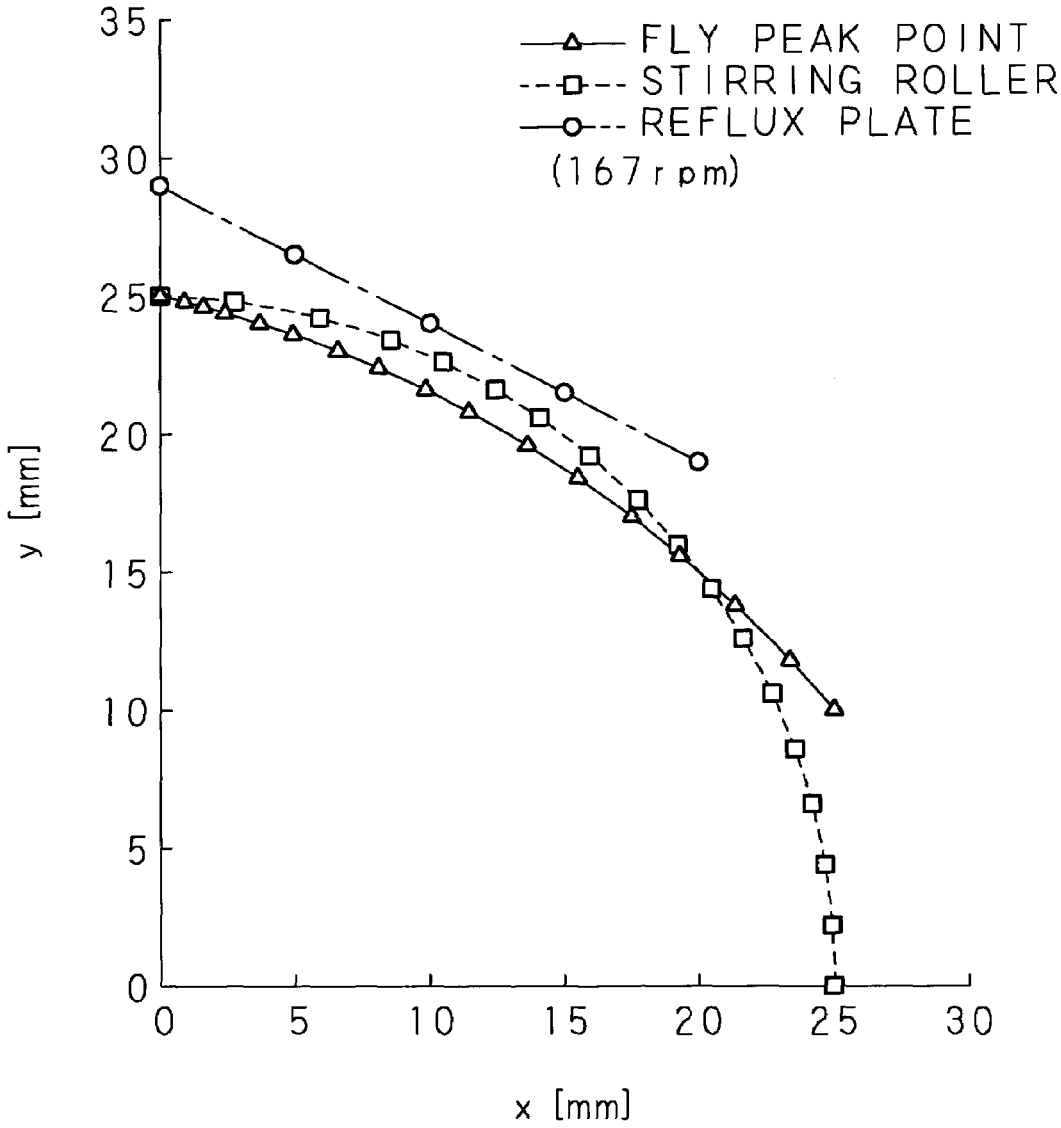
FIG. 7 is a diagram showing an example of the maximum fly distance of developer in the vertical direction.
Figure 8:
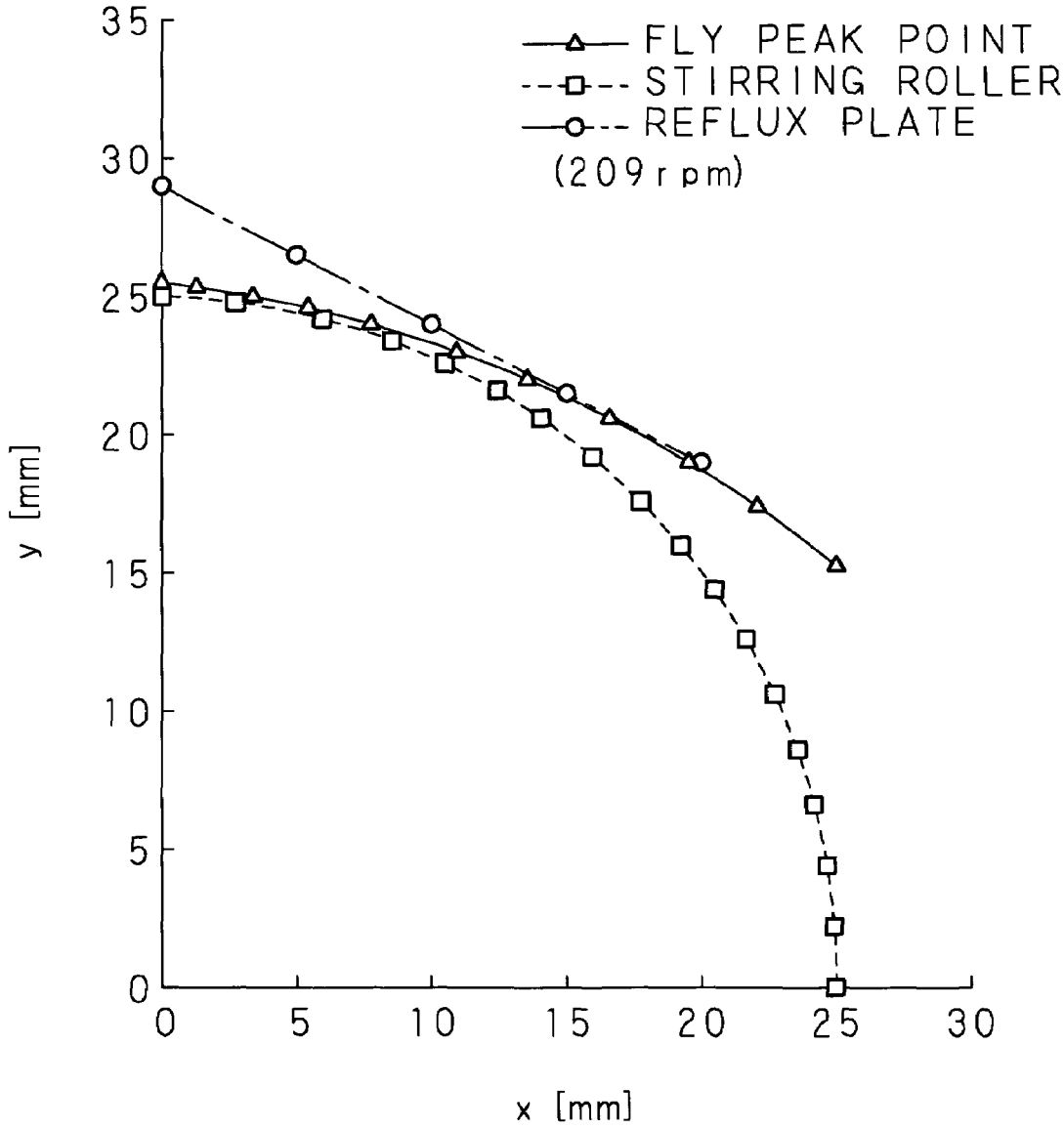
FIG. 8 is a diagram showing an example of the maximum fly distance of developer in the vertical direction.

FIG. 7 and FIG. 8 are diagrams showing examples of the maximum fly distance of the developer in the vertical direction. Here, as described above, in FIG. 2, the center of rotation of the stirring roller 7 is made to be the origin, while the horizontal rightward direction is made to be the X-direction, and the vertical upward direction is made to be the Y-direction. In FIG. 7, the rotating speed of the stirring roller 7 is 167 r.p.m. and in FIG. 8, 209 r.p.m., and each diagram shows the positional relation of the stirring roller 7, the reflux plate 6, and the maximum fly distance (the fly peak point, hereafter) of the developer in the vertical direction. The radius of the stirring roller 7 is 25 mm, and the fly peak point varies depending on the rotating speed of the stirring roller 7. The fly peak point (the maximum fly distance) depends on the rotating speed (number of rotation) of the stirring roller 7, or alternatively based on the centrifugal force caused by the rotation of the stirring roller 7, so that the lower end portion of the reflux plate 6 is disposed higher than the fly peak point. In FIG. 7, the fly peak point does not reach the lower end portion of the reflux plate 6. In contrast, in FIG. 8, the fly peak point almost reaches the lower end portion of the reflux plate 6. However, since the lower end portion of the reflux plate 6 is disposed above the fly peak point, the developer does not reach the reflux plate 6. Accordingly, the developer having flown from the stirring roller 7 is prevented from depositing on the reflux plate 6.

Further, as shown in FIG. 2, the stirring roller 7 is disposed between the developer supplying portion 1*b* and the developing roller 3, while the lower end portion of the reflux plate 6 is disposed in the vicinity of the outer periphery on the developer supplying portion 1*b* side of the stirring roller 7. In the example of FIG. 2, the lower end portion of the reflux plate 6 is disposed on the right side (in the X-direction) relative to the rotation center axis O3 of the stirring roller 7. Excess developer is flowed back by the reflux plate 6 to the developer supplying portion 1*b* side of the stirring roller 7, thereby improving the mixing of the developer having been flowed back and the developer supplied from the developer supplying portion 1*b*.

Figure 9:
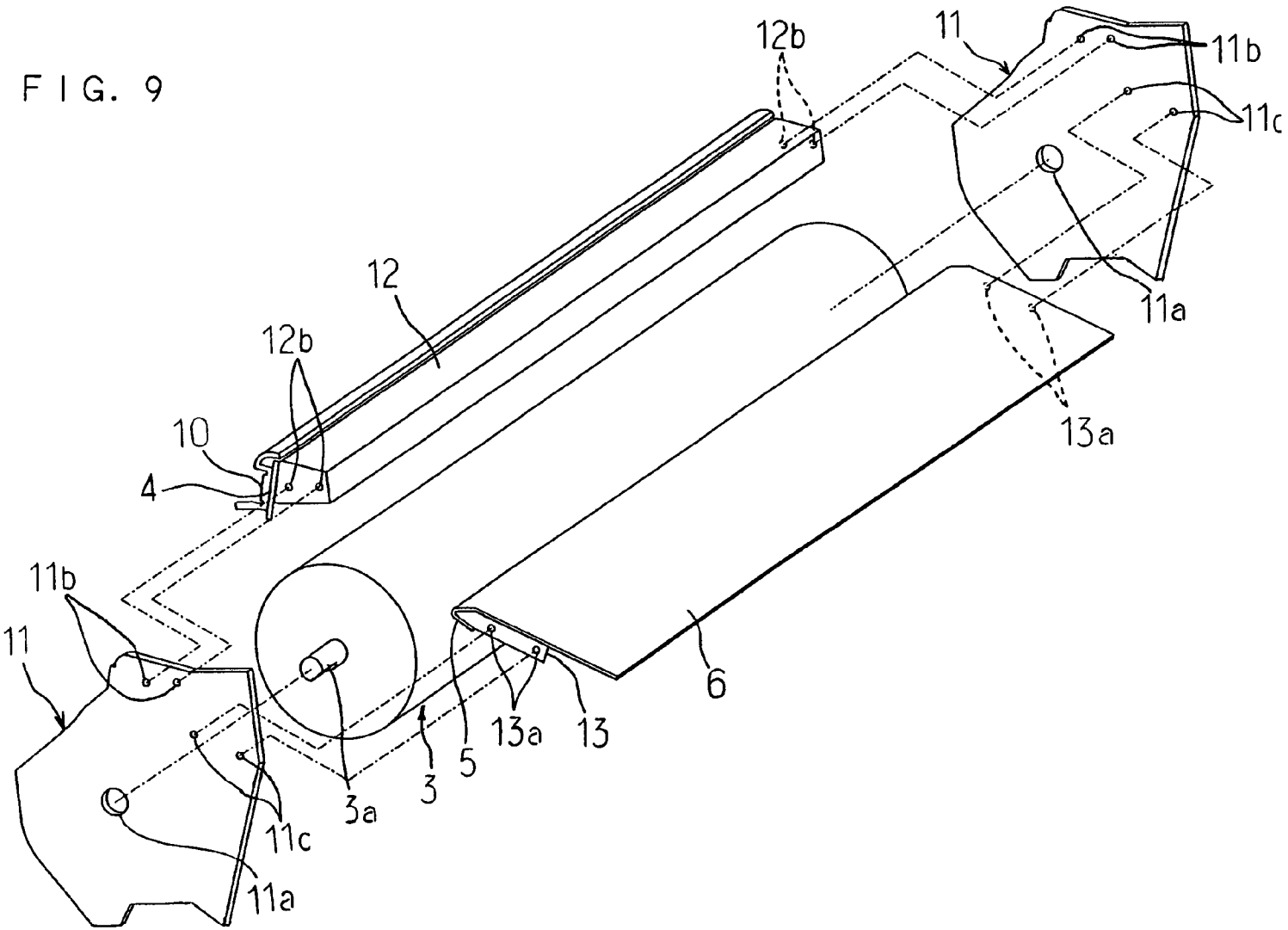

FIG. 9 is an exploded perspective view showing a supporting structure for the developing roller 3, the reflux plate 6, and the like. As shown in this figure, the developing roller 3, the control member 4, and the reflux plate 6 (scraping member 5) disposed in the case 1 are supported by two common support members 11 and 11, and is configured so as to be incorporated into the case 1 in a state supported by the support members 11 and 11.

The support members 11 and 11 consist of flat plates, and, in the respective center portions thereof, through holes 11*a* and 11*a* having a large diameter are bored into which center shaft end portions 3*a* and 3*a* of the developing roller 3 are fitted into, respectively. Further, in the support members 11 and 11, small-diameter through holes 11*b* and 11*b* facing a plurality of screw holes 12*b* and 12*b* bored at both end portions of the first developer stagnation suppressing member 12 attached to the control member 4, and small-diameter through holes 11*c* and 11*c* facing a plurality of screw holes 13*a* and 13*a* bored at both end portions of the second developer stagnation suppressing member 13 attached to the scraping member 5 and the reflux plate 6.

Then, in a state where the center shaft end portions 3*a* and 3*a* of the developing roller 3 are fitted into the through holes 11*a* and 11*a*, respectively and that the control member 4 and the scraping member 5 are disposed between the support members 11 and 11, male screws such as small screws are screwed and tightened through the through holes 11*b* and 11*c* into the screw holes 12*b* and 13*a*, so that a unit is formed. This unit can be incorporated into the case 1. The relative positional relation of the developing roller 3, the control member 4, and the reflux plate 6 (scraping member 5) can be accurately maintained, so that the amount of the first and the second gaps can be maintained. Further, the developing roller 3, the control member 4, and the reflux plate 6 (scraping member 5) can be made up in one unit, thereby improving the workability in assembling.

Further, by constituting the shape of the support members 11 and the shape of the case 1 in such a manner that the support members 11 are accurately fitted into and fixed to the case 1, the angle of inclination, the position of the lower end portion, and the like of the reflux plate 6 can be accurately maintained.

Binary developer is stored in the case 1 of the developing device configured as described above. The developer is composed of carrier such as, for example, magnetic powder, and toner. The present embodiment employs developer having a grain diameter smaller than ordinary one. Ordinary carrier has an average grain diameter of 85 μm, whereas the carrier of the present embodiment has an average grain diameter of 65 μm or smaller. Further, ordinary toner has an average grain diameter of 8.5 μm, whereas the toner of the present embodiment has an average grain diameter of 7.5 μm or smaller. When small-grain diameter developer is used, image quality can be improved.

When an electrostatic latent image carried on the photosensitive drum 2 is to be developed, the photosensitive drum 2 rotates clockwise, while the sleeve 32 of the developing roller 3 and the stirring roller 7 rotate counterclockwise. Accordingly, the developer inside the case 1 is transferred by the developing roller 3 to the second gap G2 under being stirred by the stirring roller 7. Then, the developer is controlled its transferring amount (the layer thickness) by the second gap G2, and passes through the second gap G2 under being scraped by the scraping member 5.

The developer to be transferred to the second gap G2 is transferred smoothly to the second gap G2, since its stagnation is suppressed by the second developer stagnation suppressing member 13. The developer having passed through the second gap G2 is transferred to the first gap G1. Since the second gap G2 is set up larger than the first gap G1, excess developer is surely generated by the control member 4. The excess developer is flowed back toward the reflux plate 6 in a state that the stagnation is suppressed by the first developer stagnation suppressing member 12, and is then flowed back to the stirring roller 7 by the reflux plate 6. As a whole, the developer circulates around the reflux plate 6. The angle of inclination and the position of the lower end portion of the reflux plate 6 are configured in such a manner that the reflux should be stabilized and that the transferring amount to the gap G2 should increase, as described above. Thus, circulation of the small-grain diameter developer can be stably performed.

Figure 10:
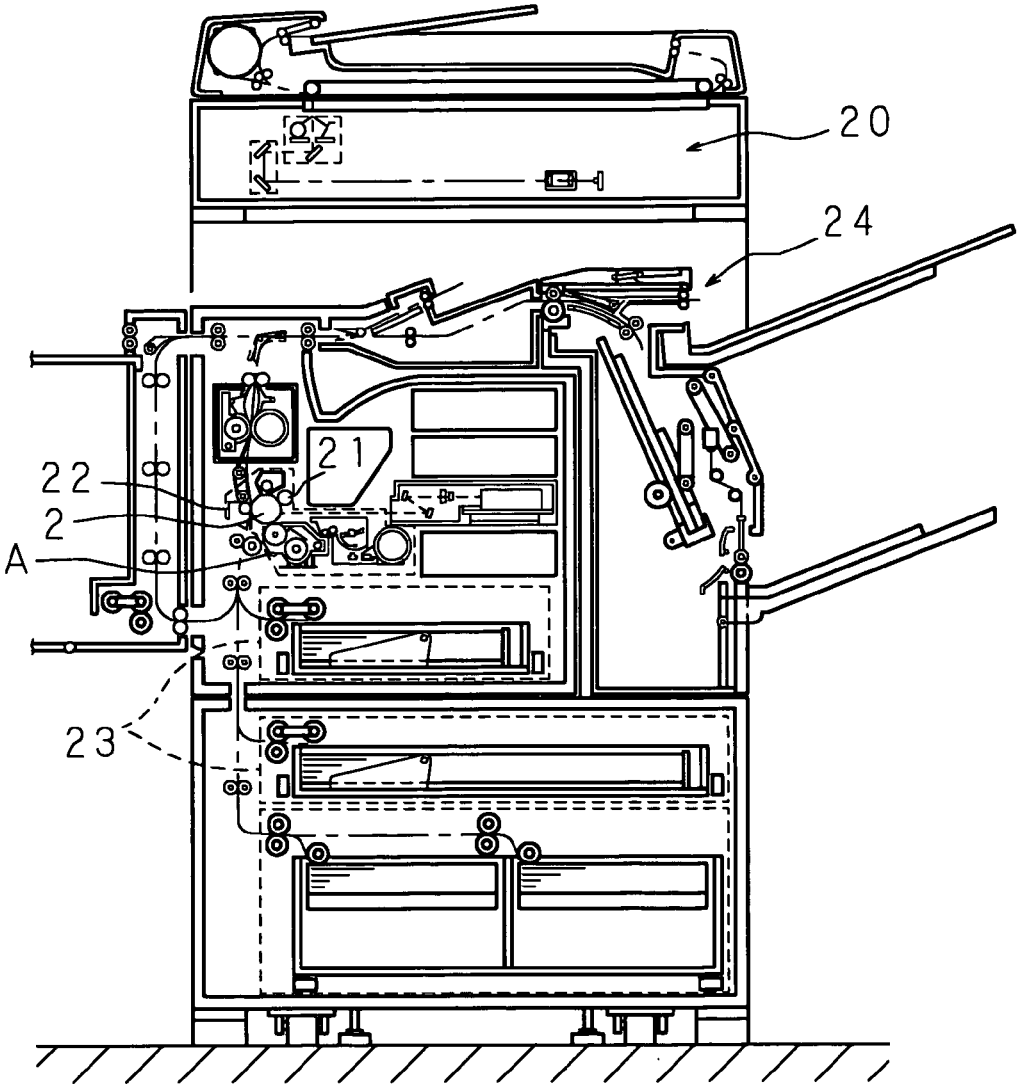
FIG. 10 is a sectional elevation front view showing the configuration of a portion of an image forming device employing a developing device according to a non-limiting embodiment.

The developing device constituted as described above is attached, for example, to a digital copying machine (image forming device) having an electro-photographic processing unit. FIG. 10 is a sectional elevation front view showing the configuration of the essential portion of an image forming device employing the developing device according to the present invention. The image forming device comprises: a scanner 20 for reading an image of an original; a photosensitive drum 2 (image forming unit) which is rotatably and carries an electrostatic latent image on its periphery surface; charging means 21 for charging the photosensitive drum 2; exposing means having a laser beam scanner for causing the photosensitive drum 2 to carry an electrostatic latent image corresponding to the original image; a developing device A for developing the above mentioned electrostatic latent image; transferring means 22 for transferring onto a sheet the developed toner image on the photosensitive drum 2; cleaning means for removing developer remaining on the photosensitive drum 2; discharging means for removing the charge on the photosensitive drum 2; a sheet feed unit 23 for feeding a sheet toward the photosensitive drum 2; and a sheet post processing unit 24 for performing post processing of the sheet on which an image has been formed.

As the aspects may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds there of are therefore intended to be embraced by the claims.

The invention claimed is:

1. A developing device, comprising:

a stirring roller having stirring blades arranged to stir a developer;

a developing roller arranged to transfer the developer to an electrostatic latent image;

a control member arranged to control an amount of the developer transferred to the electrostatic latent image by the developing roller;

a reflux plate arranged to flow back excess developer by controlling of said control member to said stirring roller; and a scraping member physically attached to said reflux plate at a vicinity of said reflux plate disposed at an outer periphery of said developing roller, wherein one end portion of said reflux plate is disposed in a vicinity of an outer periphery of said stirring roller, and part of the developer stirred by said stirring roller flies toward said reflux plate, wherein said one end portion of said reflux plate is disposed above a fly peak point in a vertical direction of said one end portion of the developer provided by a rotation of said stirring roller, wherein said one end portion of said reflux plate is disposed at a position where a plane passing through a rotation center axis of said stirring roller crosses said reflux plate at right angles, wherein an inclination angle of said reflux plate is larger than an angle of repose of the developer, wherein said scraping member faces said developing member, wherein said developing roller comprises:

a plurality of bar magnets having rectangular cross sections disposed in a radial manner, and a non-magnetic sleeve fitted outside of said plurality of bar magnets, wherein in a first gap (G1) exists between said control member and said developing roller and a second gap (G2) exists between said scraping member and said developing roller such that a relationship G1<G2 holds true, wherein the second gap G2 is a minimum gap between said scraping member and said non-magnetic sleeve, wherein one of the plurality of bar magnets faces the second gap G2, and wherein a relationship G1<G2≦0.8 Dm holds true, where Dm is a width of said bar magnet facing the second gap G2.

2. The developing device as set forth in claim 1, wherein the developer includes magnetic powder having an average grain diameter of 65 μm or smaller and toner having an average grain diameter of 7.5 μm or smaller.

3. The developing device as set forth in claim 1, further comprising:

a developer supplying portion arranged to supply the developer, wherein said stirring roller is disposed between said developer supplying portion and said developing roller, and wherein said one end portion of said reflux plate is disposed in a vicinity of an outer periphery on said developer supplying portion side of said stirring roller.

4. The developing device as set forth in claim 3, wherein the developer includes magnetic powder having an average grain diameter of 65 μm or smaller and toner having an average grain diameter of 7.5 μm or smaller.

5. The developing device as set forth in claim 1, wherein said scraping member is integrally formed with said reflux plate.

6. The developing device as set forth in claim 1, wherein a pole center axis of said bar magnet facing the second gap G2 is displaced by a predetermined angle relative a position "a" of said scraping member, the position "a" being a position where the second gap G2 is measured and being a position of minimum separation between said scraping member and said developing roller.

7. The developing device as set forth in claim 6, wherein the predetermined angle is substantially 1.5°.

8. The developing device as set forth in claim 6, wherein the predetermined angle is substantially 3.0°.

9. The developing device as set forth in claim 1, wherein an amount of the developer (M1) transferred from the first gap G1 and an amount of the developer (M2) transferred from the second gap G2 are set up such that a relationship M2>(M1/G1)G2 holds true.

10. The developing device as set forth in claim 1, wherein said developing roller comprises:

a plurality of bar magnets having rectangular cross sections disposed in a radial manner in a non-rotating magnetic roller, and a rotating non-magnetic sleeve fitted outside of said non-rotating magnetic roller, and wherein each bar magnet has a single magnetic pole of either N or S directly facing the rotating non-magnetic sleeve.

11. The developing device as set forth in claim 10, further comprising:

a scraping member physically attached to said reflux plate at a vicinity of said reflux plate disposed at an outer periphery of said developing roller; and a photo sensitive drum arranged for developing a latent image, wherein one of said plurality of bar magnets (N1) faces said photo sensitive drum and another one of said plurality of bar magnets (N2) of same magnetic polarity faces said scraping member.

12. The developing device as set forth in claim 11, wherein the magnetic pole N1 of the bar magnet facing the photo sensitive drum is displaced by a predetermined angle relative to a straight line passing through a center of said photo sensitive drum and said developing roller.

13. An image forming device, comprising:

a developing device arranged to develop an electrostatic latent image including:

a stirring roller having stirring blades arranged to stir a developer;

a developing roller arranged to transfer the developer to an electrostatic latent image;

a control member arranged to control an amount of the developer transferred to the electrostatic latent image by the developing roller;

a reflux plate arranged to flow back excess developer by controlling of said control member to said stirring roller; and a scraping member physically attached to said reflux plate at a vicinity of said reflux plate disposed at an outer periphery of said developing roller, wherein one end portion of said reflux plate is disposed in a vicinity of an outer periphery of said stirring roller, and part of the developer stirred by said stirring roller flies toward said reflux plate, wherein said one end portion of said reflux plate is disposed above a fly peak point in a vertical direction of said one end portion of the developer provided by a rotation of said stirring roller, wherein said one end portion of said reflux plate is disposed at a position where a plane passing through a rotation center axis of said stirring roller crosses said reflux plate at right angles, wherein an inclination angle of said reflux plate is larger than an angle of repose of the developer, wherein said scraping member faces said developing member, wherein said developing roller comprises:

a plurality of bar magnets having rectangular cross sections disposed in a radial manner, and a non-magnetic sleeve fitted outside of said plurality of bar magnets, wherein a first gap (G1) exists between said control member and said developing roller and a second gap (G2) exists between said scraping member and said developing roller such that a relationship G1<G2 holds true, wherein the second gap G2 is a minimum gap between said scraping member and said non-magnetic sleeve, wherein one of the plurality of bar magnets faces the second gap G2, and wherein a relationship G1<G2≦0.8 Dm holds true, where Dm is a width of said bar magnet facing the second gap G2.

14. The image forming device as set forth in claim 13, wherein the developer includes magnetic powder having an average grain diameter of 65 μm or smaller and toner having an average grain diameter of 7.5 μm or smaller.

15. The image forming device as set forth in claim 13, wherein said developing device further includes a developer supplying portion arranged to supply the developer, wherein said stirring roller is disposed between said developer supplying portion and said developing roller, and wherein said one end portion of said reflux plate is disposed in a vicinity of an outer periphery on said developer supplying portion side of said stirring roller.

16. The image forming device as set forth in claim 15, wherein the developer includes magnetic powder having an average grain diameter of 65 μm or smaller and toner having an average grain diameter of 7.5 μm or smaller.

* * * * *